US006676110B1

(12) United States Patent
Carmouche

(10) Patent No.: US 6,676,110 B1
(45) Date of Patent: Jan. 13, 2004

(54) CONCRETE FORM PULLER

(76) Inventor: Jamer M. Carmouche, 7425 Jay, Houston, TX (US) 77028

( * ) Notice: Subject to any disclaimer, the term of this patent is extended or adjusted under 35 U.S.C. 154(b) by 0 days.

(21) Appl. No.: 10/000,705

(22) Filed: Oct. 31, 2001

Related U.S. Application Data

(60) Provisional application No. 60/244,752, filed on Oct. 31, 2000.

(51) Int. Cl.[7] ..... E21B 19/00
(52) U.S. Cl. ..... 254/30
(58) Field of Search ..... 254/132, 30, 131, 254/29 R, DIG. 1, DIG. 3

(56) References Cited

U.S. PATENT DOCUMENTS 2,099,592 A * 11/1937 Barton ..... 254/30
3,647,237 A * 3/1972 Milton ..... 254/8 R
5,833,215 A * 11/1998 Vandenburg ..... 254/30

* cited by examiner

*Primary Examiner*—Robert C. Watson
(74) *Attorney, Agent, or Firm*—Jackson Walker L.L.P.

(57) ABSTRACT

A mechanical assembly for pulling the form work away from a concrete structure after the concrete structure has cured. The form work is typically wood or steel and requires a large mechanically force to free it from the concrete structure. The form puller assembly includes a lever, a fulcrum assembly, and a form pulling member. The lever pivots at the end of the fulcrum assembly and the form pulling member is connected between the lever and the section of form work to be removed. The user pulls down on the opposite end of the lever generating a mechanical force sufficient to free the form work from the concrete structure.

4 Claims, 2 Drawing Sheets

CONCRETE FORM PULLER

CROSS-REFERENCE TO RELATED APPLICATIONS

The present application claims the benefit of the filing date of U.S. Provisional Patent Application Ser. No. 60/244,752 filed on Oct. 31, 2000.

TECHNICAL FIELD

The present invention relates to construction equipment and more particularly to a device for extracting the concrete form work from the edges of the concrete after the concrete has cured; the form puller including a lever, a fulcrum assembly and a form pulling member; the fulcrum assembly including a base having a vertically oriented fulcrum tube extending upwardly from the base; the lever assembly including a tubular lever member pivotally connected to a top end of the fulcrum tube of the fulcrum assembly and having a first end rigidly connected to a U-shaped handle assembly and pivotally connected to the form pulling member at the second end; the form pulling member including a form pulling member tube having a number of pivot holes spaced along a top portion thereof to allow the form pulling member to be pivotally attached to the second end of lever member at various heights along the length thereof and a section of angled stock at the bottom end; the angled stock being perpendicular to the form pulling member tube for positioning beneath a section of concrete forming material so that the form material can be extracted as needed by pushing down on the handle of the lever when the angle stock is in place; a section of chain, in connection with the form pulling member tube, is provided for extracting various form elements such as spikes and poles which are not shaped to allow the angle stock to connect thereto.

BACKGROUND OF INVENTION

It is often difficult to remove the form from a concrete structure once the concrete has cured because the concrete becomes mechanically connected with the form material which is typically wood or steel. It would be desirable, therefore, to have a device which would allow a worker to have a mechanical advantage for forcing the form away from the concrete structure that could be easily brought to the location, set up and repositioned each time a new section of the form required removal.

SUMMARY OF INVENTION

It is thus an object of the invention to provide a concrete form puller that includes a lever, a fulcrum assembly and a form pulling member; the fulcrum assembly including a base having a vertically oriented fulcrum tube extending upwardly from the base; the lever assembly including a tubular lever member pivotally connected to a top end of the fulcrum tube of the fulcrum assembly and having a first end rigidly connected to a U-shaped handle assembly and pivotally connected to the form pulling member at the second end; the form pulling member including a form pulling member tube having a number of pivot holes spaced along a top portion thereof to allow the form pulling member to be pivotally attached to the second end of lever member at various heights along the length thereof and a section of angled stock at the bottom end; the angled stock being perpendicular to the form pulling member tube for positioning beneath a section of concrete forming material so that the form material can be extracted as needed by pushing down on the handle of the lever when the angle stock is in place; a section of chain, in connection with the form pulling member tube, is provided for extracting various form elements such as spikes and poles which are not shaped to allow the angle stock to connect thereto.

Accordingly, a concrete form puller is provided. The concrete form puller includes a lever, a fulcrum assembly and a form pulling member; the fulcrum assembly including a base having a vertically oriented fulcrum tube extending upwardly from the base; the lever assembly including a tubular lever member pivotally connected to a top end of the fulcrum tube of the fulcrum assembly and having a first end rigidly connected to a U-shaped handle assembly and pivotally connected to the form pulling member at the second end; the form pulling member including a form pulling member tube having a number of pivot holes spaced along a top portion thereof to allow the form pulling member to be pivotally attached to the second end of lever member at various heights along the length thereof and a section of angled stock at the bottom end; the angled stock being perpendicular to the form pulling member tube for positioning beneath a section of concrete forming material so that the form material can be extracted as needed by pushing down on the handle of the lever when the angle stock is in place; a section of chain, in connection with the form pulling member tube, is provided for extracting various form elements such as spikes and poles which are not shaped to allow the angle stock to connect thereto.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 1:
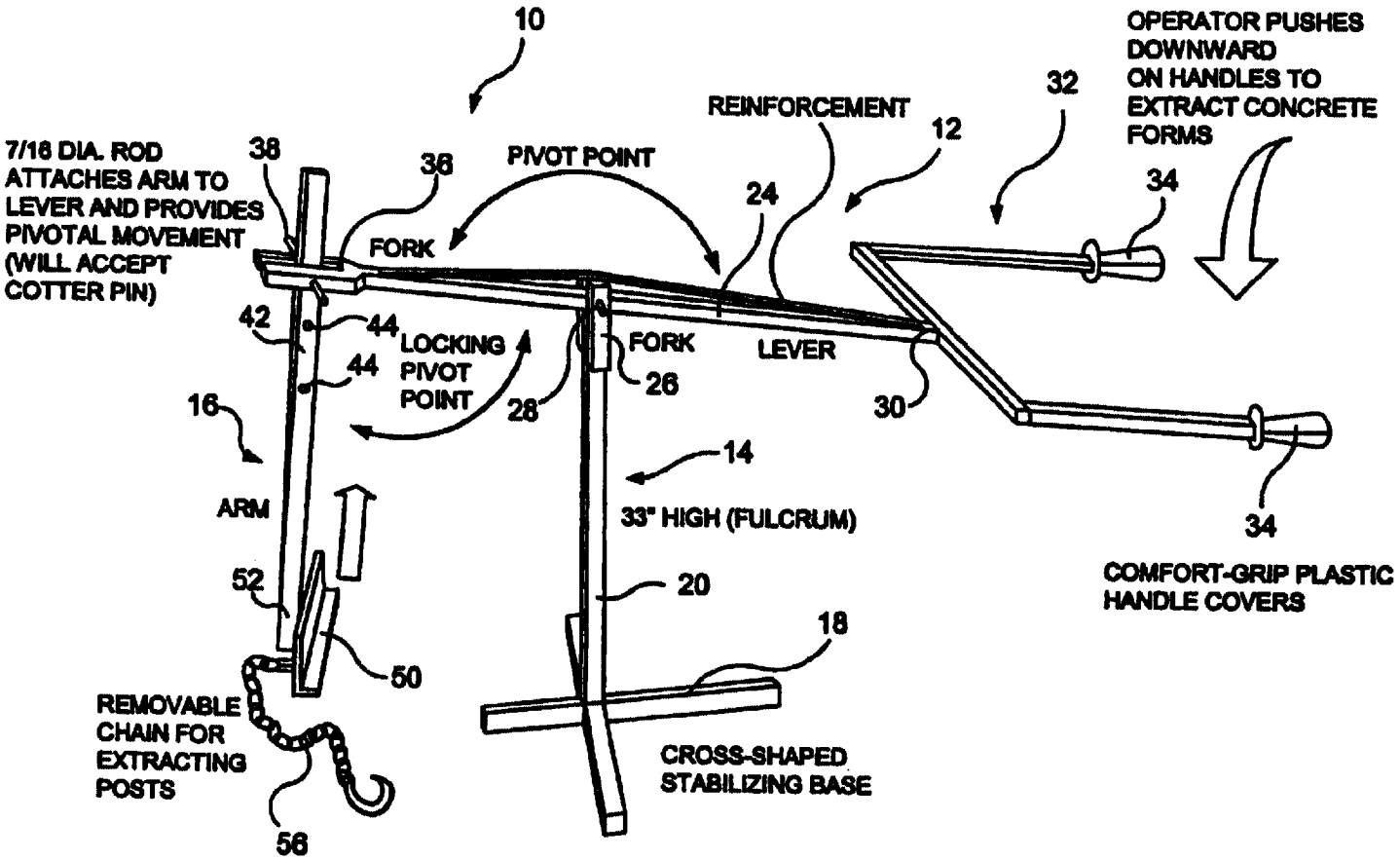
FIG. 1 is a perspective view of an exemplary embodiment of the form work puller of the present invention.
Figure 2:
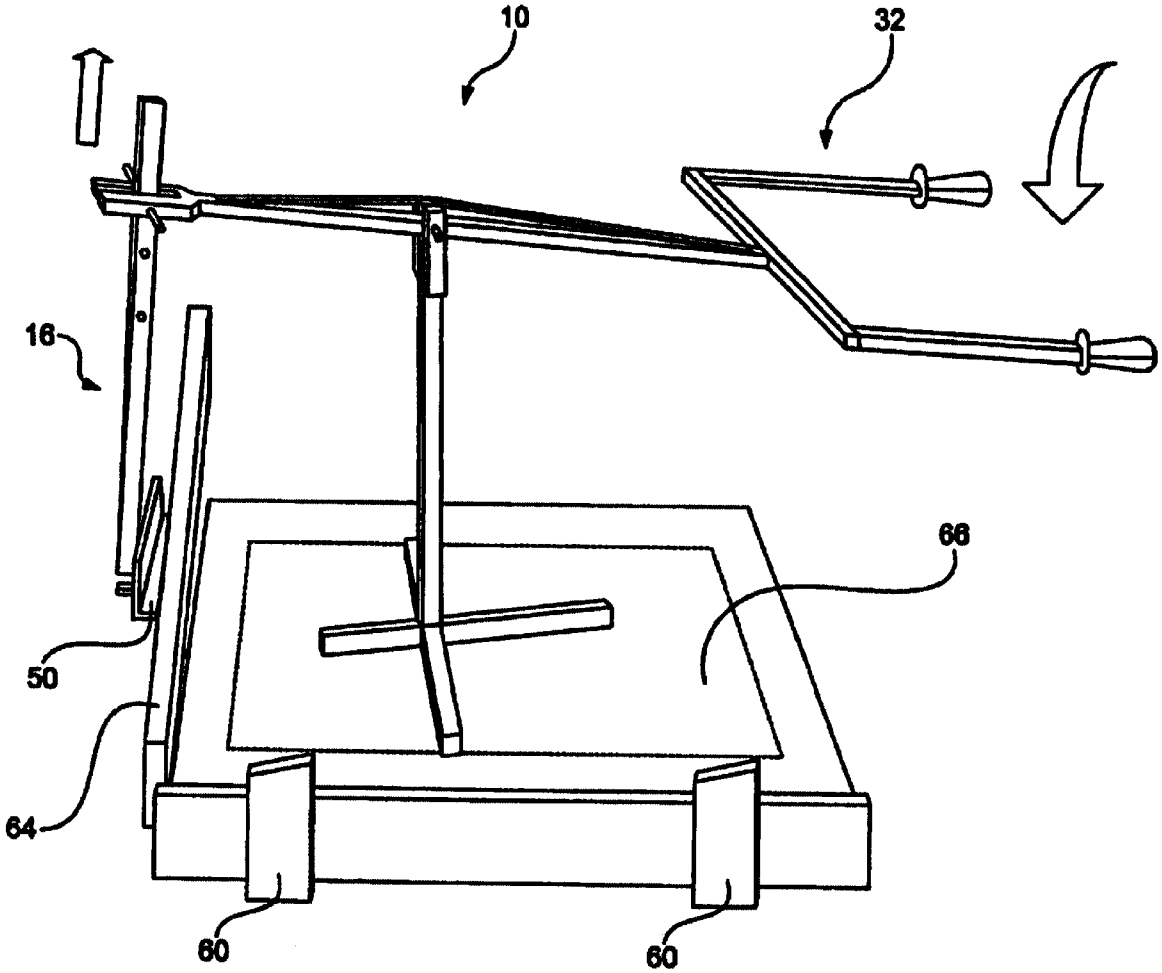
FIG. 2 is a perspective view of the form work puller of the present invention in use with a representative section of concrete and concrete form work.

FIGS. 1 and 2 show various aspects of an exemplary embodiment of the concrete form puller of the present invention generally designated 10. Concrete form puller 10 includes a lever generally designated 12, a fulcrum assembly generally designated 14 and a form pulling member generally designated 16. Fulcrum assembly 14 includes a cross shaped stabilizing base 18 from which a vertically oriented fulcrum tube 20 extends upwardly. Lever assembly 12 includes a tubular lever member 24 pivotally connected at a top end 26 of fulcrum tube 14 by a pivot pin 28 and having a first end 30 that is rigidly connected to a U-shaped handle assembly generally designated 32 having a pair of handles 34. Tubular lever member 24 has a second end 36 that is pivotally connected by a pin 38 to the pulling member tube 42 from form pulling member 16. Pulling member tube 42 is provided with a number of holes 44 to allow the user to adjust the height of the piece of angle stock 50 rigidly attached to the bottom end 52 of pulling tube 42. A removable chain 56 is provided in connection with pulling member 16 for pulling posts and stakes 60 out of the ground. In use, angle stock portion 50 is positioned beneath a section of wood, concrete form material 64 and pulled away from the concrete structure 66 by pushing down on handle assembly 32 causing form pulling member 16 to move in an upward direction freeing form wood 64 from concrete structure 66.

It can be seen from the preceding description that a concrete form puller has been provided.

It is noted that the embodiment of the concrete form puller described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A form puller device for extracting the concrete form work from the edges of a concrete slab section after the concrete has cured; the form puller device comprising:

a lever assembly;

a fulcrum assembly; and a form pulling member;

the fulcrum assembly including a base having a vertically oriented fulcrum tube extending upwardly from the base;

the lever assembly including a tubular lever member pivotally connected to a top end of the fulcrum tube of the fulcrum assembly and having a first end rigidly connected to a U-shaped handle assembly and a second end pivotally connected to the form pulling member;

the form pulling member including a form pulling member tube having a top end and a bottom end and a number of pivot holes spaced along a top portion thereof to allow the form pulling member to be pivotally attached to the second end of the lever assembly at various heights along the length thereof and a section of angled stock connected to the bottom end of the form pulling member tube; the angled stock being perpendicular to the form pulling member tube for positioning beneath a section of concrete forming material so that the forming material can be extracted as needed by pushing down on the U-shaped handle assembly of the lever assembly when the angle stock is in place; a section of chain, in connection with the form pulling member tube, is provided for extracting various form elements such as spikes and poles which are not shaped to allow the angle stock to connect thereto.

2. Apparatus for extracting a concrete form from the edge of a concrete section after the concrete section has cured, said apparatus comprising:

(a) a fulcrum assembly comprising: (i) a vertical member having an upper end and a lower end, and (ii) a stabilizing base rigidly connected to the lower end of the vertical member;

(b) a lever assembly comprising: (i) a horizontal member having a first end and a second end, said horizontal member being pivotally connected to the upper end of the vertical member of the fulcrum assembly at a position between the first end and second end, and (ii) a U-shaped handle assembly rigidly connected to the first end of the horizontal member; and (c) a form pulling assembly comprising: (i) a pulling member having a top end pivotally connected to the second end of the horizontal member of the lever assembly and a bottom end, and (ii) an angle section comprising a flat vertical element and a flat horizontal element, said angle section rigidly connected to the bottom end of the pulling member, said flat horizontal element arranged for positioning beneath the concrete form to facilitate extraction of the concrete form from the concrete section.

3. The apparatus of claim 2, further comprising a chain assembly for wrapping around and extracting form elements such as spikes and poles which are not shaped to allow the angle section to engage thereto, said chain assembly connected to the bottom end of the form pulling assembly.

4. The apparatus of claim 2, wherein the vertical member of the fulcrum assembly, the horizontal member of the lever assembly, and the pulling member are fabricated from structural tubing.

* * * * *